US011674769B2

(12) United States Patent
Howard et al.

(10) Patent No.: US 11,674,769 B2
(45) Date of Patent: Jun. 13, 2023

(54) SYSTEMS AND METHODS FOR PROJECTILE PROPULSION

(71) Applicants: T. Dashon Howard, Chicago, IL (US); Chris Seely, New Brunswick (CA)

(72) Inventors: T. Dashon Howard, Chicago, IL (US); Chris Seely, New Brunswick (CA)

(73) Assignee: T. DASHON HOWARD, Chicago, IL (US)

( * ) Notice: Subject to any disclaimer, the term of this patent is extended or adjusted under 35 U.S.C. 154(b) by 0 days.

(21) Appl. No.: 17/957,805

(22) Filed: Sep. 30, 2022

(65) Prior Publication Data

US 2023/0040922 A1 Feb. 9, 2023

Related U.S. Application Data

(63) Continuation of application No. 17/160,081, filed on Jan. 27, 2021, now Pat. No. 11,460,260.

(51) Int. Cl.
*F41A 19/69* (2006.01)
*F41A 1/04* (2006.01)
(Continued)

(52) U.S. Cl.
CPC ..... *F41A 19/69* (2013.01); *F41A 1/04* (2013.01); *F41A 19/58* (2013.01); *F41A 19/60* (2013.01)

(58) Field of Classification Search
CPC ..... F41A 19/69; F41A 19/58; F41A 19/59; F41A 19/60; F41A 19/61; F41A 19/62;
(Continued)

(56) References Cited

U.S. PATENT DOCUMENTS 605,842 A * 6/1898 Bates ..... F42B 5/02 89/27.13
4,913,029 A * 4/1990 Tidman ..... F41B 6/00 318/135
(Continued)

FOREIGN PATENT DOCUMENTS

FR 2581751 A1 * 5/1985 ..... F42C 11/08
FR 2666643 3/1992
(Continued)

OTHER PUBLICATIONS

"U.S. Appl. No. 17/160,081, Notice of Allowance dated May 26, 2022", 14 pgs.
(Continued)

*Primary Examiner* — John Cooper
(74) *Attorney, Agent, or Firm* — Schwegman Lundberg & Woessner, P.A.

(57) ABSTRACT

A projectile propulsion system comprises a housing defining a chamber, a propulsive charge including a propulsive charge material loadable into the chamber, a projectile loadable into the chamber proximate to the propulsive charge material, an electric pulse discharge subsystem that provides an electric pulse having a specified pulse amperage for a specified pulse period, a current delivery subsystem electrically connecting the electric pulse discharge subsystem to the chamber to deliver the electric pulse to the propulsive charge material, wherein the specified pulse amperage and the specified pulse period are sufficient to cause at least a portion of the propulsive charge material to generate a propulsive force that is at least partially directed onto the projectile to drive the projectile out of the chamber, and a barrel in fluid communication with the chamber configured to receive the projectile as it is driven from the chamber.

20 Claims, 6 Drawing Sheets

(51) Int. Cl.
*F41A 19/58* (2006.01)
*F41A 19/60* (2006.01)

(58) Field of Classification Search
CPC ..... F41A 19/63; F41A 19/64; F41A 19/65; F41A 19/66; F41A 19/67; F41A 19/68; F41A 19/70; F41A 1/04
USPC ..... 89/135, 28.05
See application file for complete search history.

(56) References Cited

U.S. PATENT DOCUMENTS

| | | | | |
|---|---|---|---|---|
| 4,974,487 | A * | 12/1990 | Goldstein | F41B 6/00 219/121.36 |
| 5,010,804 | A * | 4/1991 | Lee | F41A 1/00 89/7 |
| 5,012,719 | A | 5/1991 | Goldstein et al. | |
| 5,355,764 | A | 10/1994 | Marinos et al. | |
| 6,220,141 | B1 * | 4/2001 | Fitter | F41B 9/00 89/8 |
| 6,415,716 | B1 | 7/2002 | Sanford et al. | |
| 8,342,097 | B1 | 1/2013 | Widder et al. | |
| 11,460,260 | B2 | 10/2022 | Howard et al. | |
| 2004/0200731 | A1 * | 10/2004 | Sullivan | C25B 15/00 205/628 |
| 2006/0026884 | A1 | 2/2006 | Cerovic et al. | |
| 2006/0027084 | A1 | 2/2006 | Schneider | |
| 2010/0089273 | A1 | 4/2010 | Kroll et al. | |
| 2010/0101445 | A1 | 4/2010 | Garg | |
| 2022/0236027 | A1 | 7/2022 | Howard et al. | |

FOREIGN PATENT DOCUMENTS

| | | |
|---|---|---|
| JP | H05223496 | 8/1993 |
| WO | WO-2022178477 A2 | 8/2022 |
| WO | 2022178477 | 11/2022 |

OTHER PUBLICATIONS

"U.S. Appl. No. 17/160,081, Response filed May 2, 2022 to Restriction Requirement dated Mar. 11, 2022", 7 pgs.
"U.S. Appl. No. 17/160,081, Restriction Requirement dated Mar. 11, 2022".
"International Application Serial No. PCT US2022 070370, International Search Report dated Oct. 7, 2022", 4 pgs.
"International Application Serial No. PCT US2022 070370, Written Opinion dated Oct. 7, 2022", 5 pgs.
U.S. Appl. No. 17/160,081 U.S. Pat. No. 11,460,260, filed Jan. 27, 2021, Systems and Methods for Projectile Propulsion.

* cited by examiner

SYSTEMS AND METHODS FOR PROJECTILE PROPULSION

PRIORITY APPLICATION

This application is a continuation of U.S. patent application Ser. No. 17/160,081, filed Jan. 27, 2021, the content of which is incorporated herein by reference in its entirety.

BACKGROUND

Conventionally, projectile weapons are powered by chemical potential energy that is converted into kinetic energy. For example, a conventional firearm round includes gunpowder, smokeless powder, or some other propellant that is ignited by a primer, which causes the propellant to deflagrate. Gases from the burning propellant become pressurized and expand, which push a projectile, such as a bullet or slug, out of the firing chamber and through the bore of a gun barrel.

While chemical-based projectile weapons have been the standard for hundreds of years, the small amount of propellant that can be practically placed in the small volume of the firing chamber limits the propulsive force that can be generated, and therefore limits the speed at which the projectile can be fired and the distance that the projectile can be shot.

SUMMARY OF THE DISCLOSURE

The present disclosure describes systems and methods for projectile propulsion where the propulsive force is supplied by an electrically overloaded capacitor, which causes a portion of the capacitor to explode and generate an explosive propulsive force to propel a projectile with substantially more force and at a substantially higher speed than is achievable by a conventional powder-based round having a similar size.

This summary is intended to provide an overview of subject matter of the present disclosure. It is not intended to provide an exclusive or exhaustive explanation of the invention. The detailed description is included to provide further information about the present disclosure.

BRIEF DESCRIPTION OF THE DRAWINGS

In the drawings, which are not necessarily drawn to scale, like numerals may describe similar components in different views. The drawings illustrate generally, by way of example, but not by way of limitation, various embodiments discussed in the present document.

DETAILED DESCRIPTION

Figure 1:
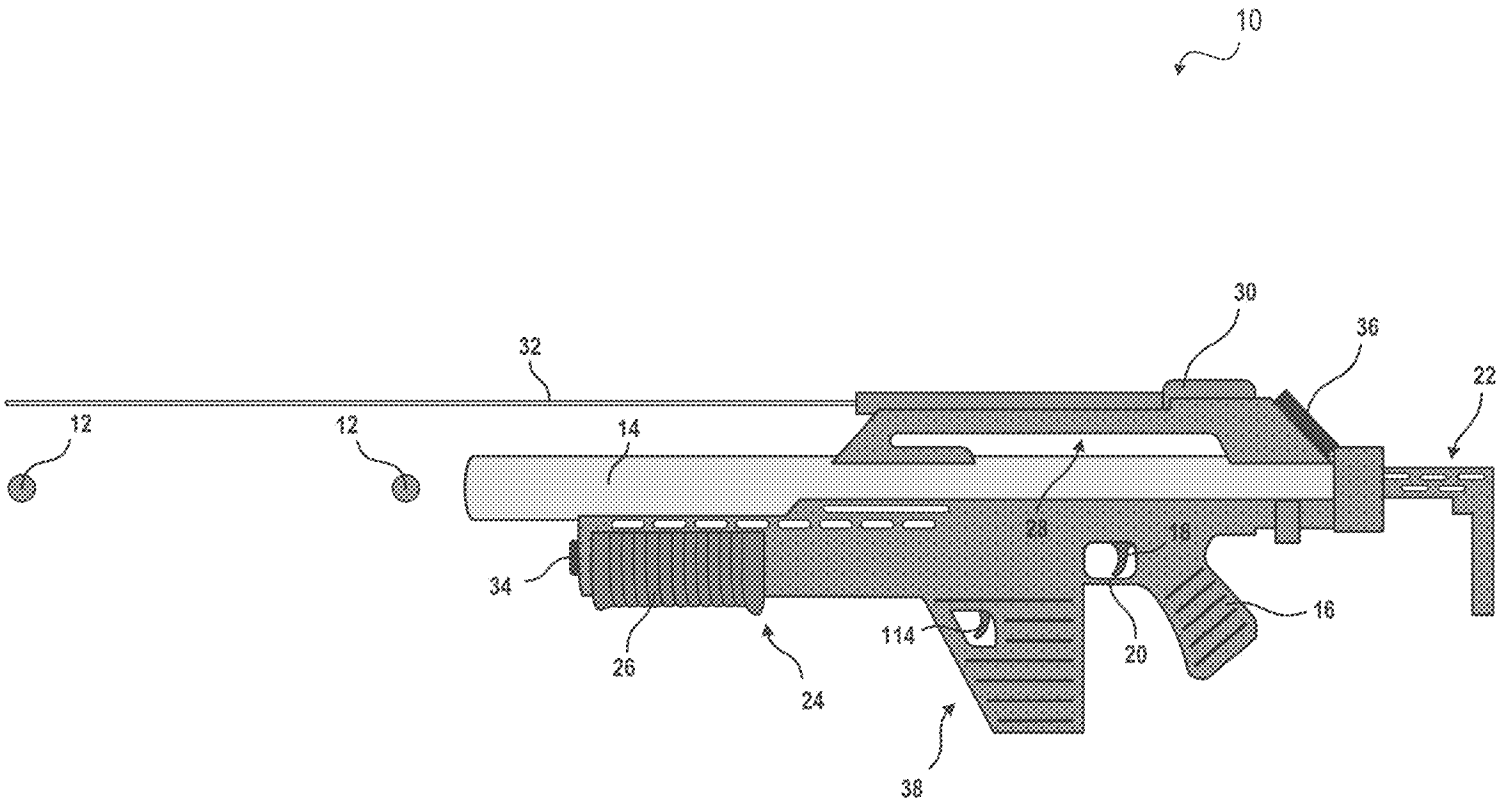
FIG. 1 is a side view of an example weapon configured to propel a projectile via force generated by applying an electric pulse to a propulsive charge.

The following detailed description discloses a novel weapons system and a novel method for propelling a projectile. Specifically, the present disclosure describes novel propellant mechanisms for providing the propulsive energy to eject the projectile from a propulsion chamber. In an example, the novel propellant mechanism comprises electrically overloading a capacitor and a projectile positioned at a leading end of the propulsive charge. When the capacitor is electrically overloaded with a short burst electric pulse having sufficiently high amperage—e.g., on the order of several kiloamps or more—in a sufficiently short period of time—e.g., for a few microseconds or less—the burst of electric energy provided by the overloading pulse causes a portion of the capacitor to generate an explosive propulsive force. For example, if an electrolyte is used for one or more of the conductive structures within the capacitor, the burst of energy from the overloading pulse can essentially instantaneously vaporize the electrolyte, which will then expand rapidly to generate the propulsive force. In some examples, the propulsive force generated by electrically overloading the capacitor is substantially larger than the force that is achievable by conventional powder-based ammunition. The large propulsive force that is produced by the overloaded capacitor can be directed toward the projectile so that the propulsive force drives the projectile forward out of the weapon, e.g., through a barrel that is in fluid communication with the chamber in which the capacitor overloading takes place.

In another example, the propellant mechanism comprises generation of an electrostatic arc-liberated water explosion, which generates a rapidly expanding cold water vapor or cold fog cloud that can be channeled to propel a projectile from the weapon. Similar to the electrical overloading of the capacitor in the previous example, it has been found that arc-liberated water explosions can also generate a substantial amount of propulsive force that can be used to drive the projectile at a high speed.

The present detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The example embodiments may be combined, other embodiments may be utilized, or structural, and logical changes may be made without departing from the scope of the present invention. While the disclosed subject matter will be described in conjunction with the enumerated claims, it will be understood that the exemplified subject matter is not intended to limit the claims to the disclosed subject matter. The following detailed description is, therefore, not to be taken in a limiting sense, and the scope of the present invention is defined by the appended claims and their equivalents.

References in the specification to "one embodiment", "an embodiment," "an example embodiment," etc., indicate that the embodiment described can include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a concentration range of "about 0.1% to about 5%" should be interpreted to include not only the explicitly recited concentration of about 0.1 wt. % to about 5 wt. %, but also the individual concentrations (e.g., 1%, 2%, 3%, and 4%) and the sub-ranges (e.g., 0.1% to 0.5%, 1.1% to 2.2%, and 3.3% to 4.4%) within the indicated range. The statement "about X to Y" has the same meaning as "about X to about Y,"" unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. Unless indicated otherwise, the statement "at least one of" when referring to a listed group is used to mean one or any combination of two or more of the members of the group. For example, the statement "at least one of A, B, and C" can have the same meaning as "A; B; C; A and B; A and C; B and C; or A, B, and C," or the statement "at least one of D, E, F, and G" can have the same meaning as "D; E; F; G; D and E; D and F; D and G; E and F; E and G: F and G; D, E, and F; D, E, and G; D, F, and G; E, F, and G; or D, E, F, and G." A comma can be used as a delimiter or digit group separator to the left or right of a decimal mark; for example, "0.000,1" is equivalent to "0.0001."

In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

In the methods described herein, the steps can be carried out in any order without departing from the principles of the invention, except when a temporal or operational sequence is explicitly recited. Furthermore, specified steps can be carried out concurrently unless explicit language recites that they be carried out separately. For example, a recited act of doing X and a recited act of doing Y can be conducted simultaneously within a single operation, and the resulting process will fall within the literal scope of the process. Recitation in a claim to the effect that first a step is performed, and then several other steps are subsequently performed, shall be taken to mean that the first step is performed before any of the other steps, but the other steps can be performed in any suitable sequence, unless a sequence is further recited within the other steps. For example, claim elements that recite "Step A, Step B, Step C, Step D, and Step E" shall be construed to mean step A is carried out first, step E is carried out last, and steps B, C, and D can be carried out in any sequence between steps A and E (including with one or more steps being performed concurrent with step A or Step E), and that the sequence still falls within the literal scope of the claimed process. A given step or sub-set of steps can also be repeated.

Furthermore, specified steps can be carried out concurrently unless explicit claim language recites that they be carried out separately. For example, a claimed step of doing X and a claimed step of doing Y can be conducted simultaneously within a single operation, and the resulting process will fall within the literal scope of the claimed process.

The term "about" as used herein can allow for a degree of variability in a value or range, for example, within 10%, within 5%, within 1%, within 0.5%, within 0.1%, within 0.05%, within 0.01%, within 0.005%, or within 0.001% of a stated value or of a stated limit of a range, and includes the exact stated value or range.

The term "substantially" as used herein refers to a majority of, or mostly, such as at least about 50%, 60%, 70%, 80%, 90%, 95%, 96%, 97%, 98%, 99%, 99.5%, 99.9%, 99.99%, or at least about 99.999% or more, or 100%.

In addition, it is to be understood that the phraseology or terminology employed herein, and not otherwise defined, is for the purpose of description only and not of limitation. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

FIG. 1 shows a side view of an example projectile weapon 10 that incorporates one or more of methods of propulsive force generation via application of a large electric pulse with a specified pulse amperage and/or a specified pulse voltage for a specified period of time, as discussed briefly above. The projectile weapon 10, which will also be referred to simply as "the weapon 10" for the sake of brevity, is configured to propel a projectile 12, such as a bullet, a slug, or a ball, by taking advantage of the propulsive force generated by converting electrical energy to kinetic energy, described in more detail below.

The weapon 10 includes many aspects that are similar or even identical to those of more conventional, powder-based firearms. For example, the projectile 12 is ejected from the weapon 10 via a barrel 14. The weapon 10 includes a grip 16 that a user can use to hold the weapon 10 when firing. A firing trigger 18 is located close to the grip 16, which can be actuated by the user to initiate the sequence that fires the projectile 12. A trigger guard 20 can be included around the trigger 18 to minimize the likelihood of accidental firing of the weapon 10. The weapon 10 shown in FIG. 1 is configured like a rifle with a buttstock 22, also referred to simply as "the stock 22," at a proximal end of the weapon 10 that the user can abut against his or her shoulder or other part of the body for stability while firing the weapon 10. A forestock 24 closer to the distal end of the weapon 10 can be held by the hand opposite his or her trigger hand to aim and further steady the weapon 10 during firing. In an example, a handguard 26 is provided around a portion of the forestock 24 to protect the user's hand, such as from heat that may be generated by firing of the weapon 10 and dissipated through the forestock 24 by heat conduction.

In an example, the weapon 10 also includes a carrying handle 28 on a top side of the barrel 14 to provide another option for carrying the weapon 10. In an example, the handle 28 can also provide a mounting location for a targeting device or mechanism 30 so that the targeting device or mechanism 30 will be at a specified location and orientation relative to the barrel 14 for accurate targeting. In an example, the targeting device or mechanism 30 comprises a laser targeting system 30 that emits a laser 32 for highly precise targeting. In another example, in addition to or in place of the laser targeting system 30, the weapon 10 can include a high resolution or ultra-high resolution camera 34 directed forward from the weapon 10, such as on a distal end of the forestock 24. The camera 34 can capture an image or video of a target, which the user can view, for example on a small display 36 that can be conveniently viewed by the user during firing, such as proximate to the stock 22 at the proximal end of the weapon 10. In an example, a reticle can be superimposed over the image or video captured by the camera 34 to indicate to the user the expected location where the projectile 12 will travel.

In an example, the weapon 10 can include an on-board computer that can control one or more subsystems of the weapon 10 such as the laser targeting system 30, the camera 34, and the display 36. The on-board computer or a computer-readable medium accessible by the on-board computer can be programmed to further assist the user in targeting. The programming can include one or more instructions to assist the user or otherwise enhance firing of the weapon 10. Examples of the one or more instructions that can be programmed onto the on-board computer or a computer-readable medium accessible by the on-board computer include, but are not limited to:

a) calculating distance to a target acquired by the laser targeting system 30 and/or the camera 34;

b) measuring or acquiring information regarding one or more meteorological conditions that can effect viewing of the target and/or the path of the projectile 12 through the air after it leaves the barrel 14, including, but not limited to, wind speed, wind direction, air temperature, air updraft or downdraft, relative humidity, altitude, and the like;

c) compensating the targeting to account for one or more conditions such as the distance to the target or one or more of the meteorological conditions;

d) analyzing information provided by the laser targeting system 30, which can be configured as a sensor for measuring one or more of the meteorological conditions in addition to being used as a targeting laser;

e) synthesizing information captured by both the laser targeting system 30 and the high resolution camera 34 to provide for more accurate targeting than would be achieved by either alone;

f) processing or analyzing the image or video captured by the camera 34 in order to identify or extract one or more physical features, such as for edge recognition, corner recognition, contour recognition, facial recognition, mapping one or more structures in the image or video, color detection and/or color mapping, identifying object based on data extracted from the image or video captured by the camera 34, determining motion of one or more objects or structures in the captured image or video and/or estimating where the object or structure will move in a specified future time period;

g) acquiring navigational information, such as from a GPS satellite and providing information regarding location of one or more of the weapon 10, a target acquired by a targeting device or mechanism 30 such as the laser targeting system 30 or the high resolution camera 34, and a projectile 12 that has been fired by the weapon 10; and h) measuring or calculating information regarding charging and firing-readiness of the weapon 10 and/or providing such information to the user, for example through the display 36.

Capacitive Projectile Propulsion

In addition to the more conventional aspects of the weapon 10 described above, the weapon 10 includes a novel means of generating the propulsive energy that drives the projectile 12 out of the barrel 14 at a high speed. As mentioned above, in an example the propulsive force is generated by electrically overloading a capacitor, which causes a portion of the capacitor to generate a propulsive force that propels the projectile 12.

Figure 2:
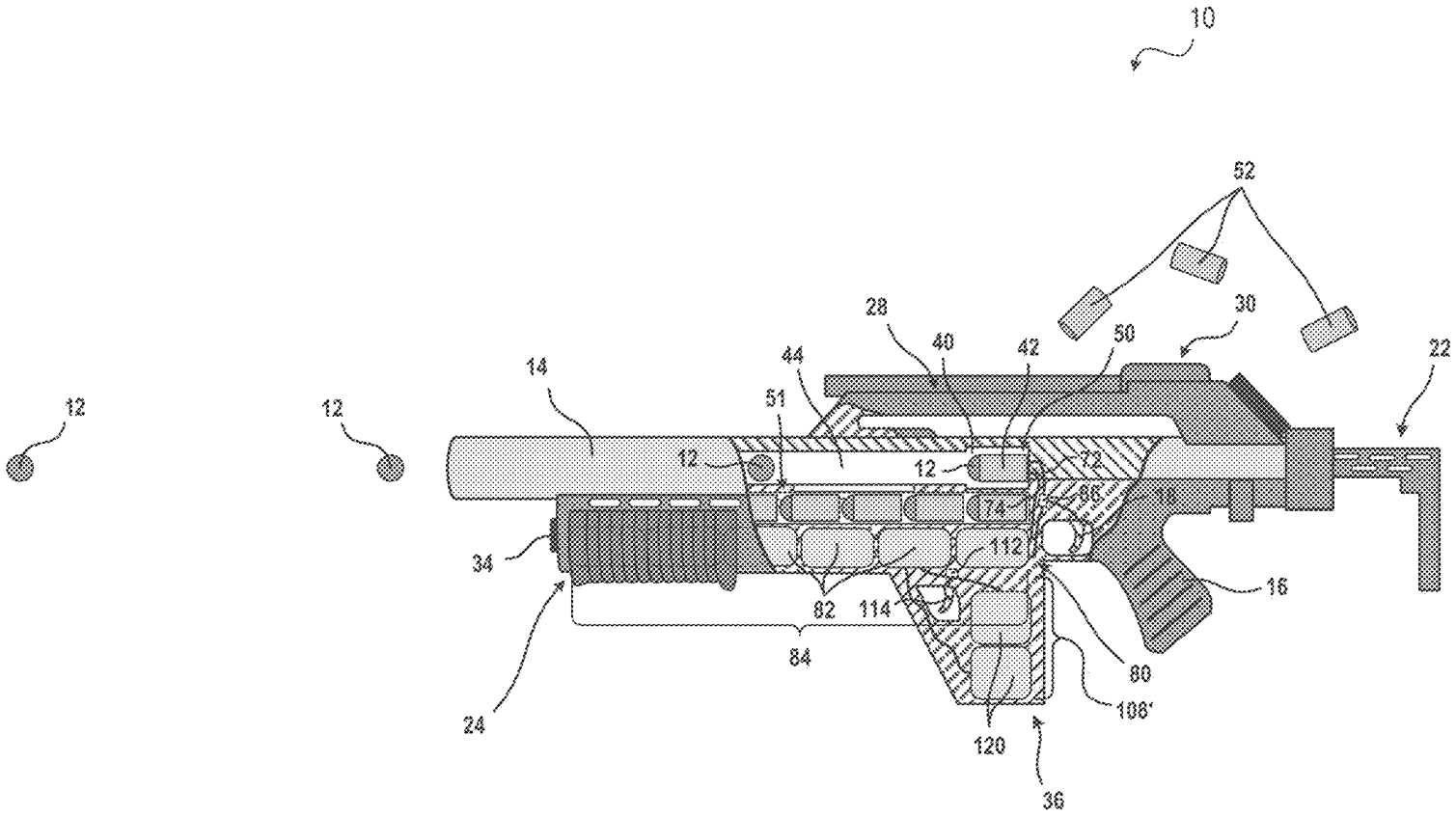
FIG. 2 is a partial cross-sectional side view of the example weapon of FIG. 1.

FIG. 2 shows a partial cross-sectional view of the weapon 10 that reveals the structures that can provide for this capacitive-based propulsive force. In an example, the weapon 10 includes an internal housing defining a propulsion chamber 40 (also referred to hereinafter as "the chamber 40") that can receive both the projectile 12 and a propulsive capacitor 42 (also referred to hereinafter as "the capacitor 42"). The weapon 10 further comprises one or more subsystems configured to electrically overload the capacitor 42 to generate an explosive propulsive force in order to drive the projectile 12 from the chamber 40, such as through a bore 44 within the barrel 14.

In an example, the capacitor 42 includes an electrolyte, such as in an electrolytic capacitor wherein the cathode is formed at least in part by an electrolyte. In such an example, the electrical overloading of the capacitor 42 causes the electrolyte to vaporize. If the electrical overloading occurs in a short enough period of time and with sufficient electrical energy, this vaporizing of the electrolyte can manifest as an explosive expansion of gas that can drive the projectile 12 with a very large amount of propulsive force.

Figure 3A:
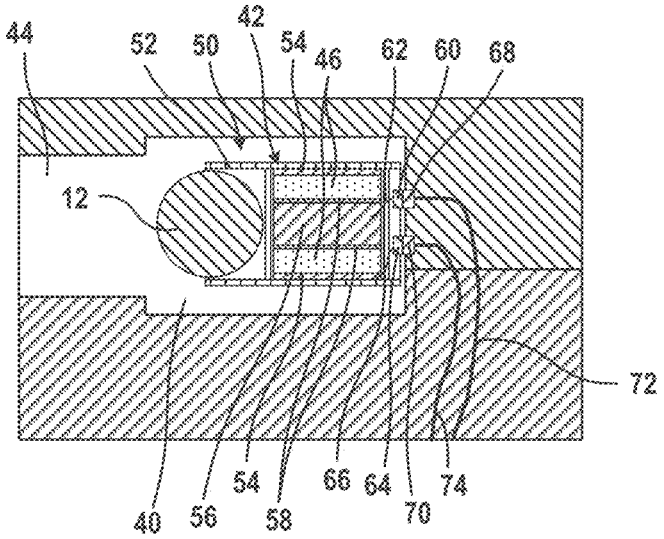
FIGS. 3A-3C are close-up cross-sectional side views of an example propulsive cartridge that uses the force generated by electrically overloading a capacitor to propel a projectile from a propulsion chamber in the example weapon of FIGS. 1 and 2 at different points in time during firing of the weapon.
Figure 3B:
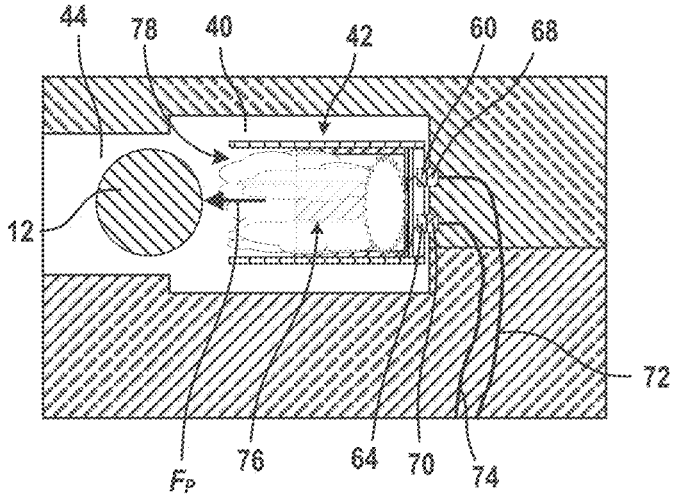
Figure 3C:
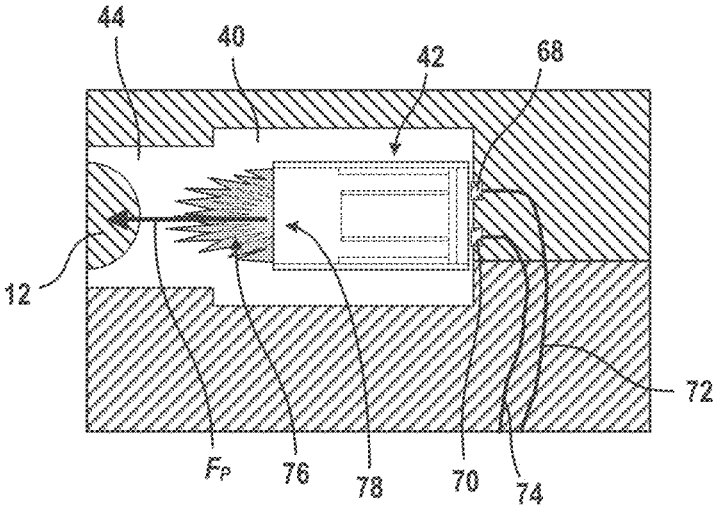

FIGS. 3A, 3B, and 3C show close up views of an example propulsive capacitor 42 within the chamber 40 at three points in time during firing of the weapon 10. FIG. 3A shows the capacitor 42 before firing of the weapon 10 has begun, e.g., such that the propulsive capacitor 42 is fully intact. The capacitor 42 and the projectile 12 are positioned within the chamber 40. In an example, the projectile 12 and the capacitor 42 are combined together in a single structure 50, similar to the charge and the projectile of a powder-based cartridge. For that reason, the combined structure 50 of the projectile 12 and the capacitor 42 will be referred to hereinafter as "the capacitive cartridge 50" or simply as "the cartridge 50." In an example, the cartridge 50 includes a casing 52 that at least partially surrounds the capacitor 42 and at least a portion of the projectile 12 so that the cartridge 50 can be easily transported as a single unit. The casing 52 can also act to direct the force that is generated by the vaporized electrolyte 46 so that the projectile 12 is driven in the desired forward direction.

In an example, the weapon 10 includes a storage chamber 51 for holding cartridges 50 that can be loaded into the chamber 40, e.g., after a previous cartridge 50 has been fired to eject its projectile 12 from the weapon 10. The weapon 10 can also include a passageway (not shown) through which a cartridge 50 can be loaded into the chamber 40. Such a passageway can connect the cartridge storage chamber 51 on one end and with the chamber 40 on the other end. The weapon 10 can further include a mechanism for loading an unfired capacitor 42 to the chamber 40, e.g., by moving the capacitor 42 from the cartridge storage chamber 51 to the chamber 40 through the passageway. The weapon 10 can also include a mechanism (not shown) for ejecting spent casings 52 from the weapon 10 (e.g., as shown in FIG. 2) after the capacitor 42 has been overloaded and the projectile 12 has been fired.

As noted above, in an example, the capacitor 42 is an electrolytic capacitor. In an example, the electrolytic cathode 42 includes a cathode metal 54 that is in electrical communication with the electrolyte 46 and an anode 56 that is separated from the electrolyte 46 by an oxide layer 58 formed on the anode 56. The cathode metal 54 and the electrolyte 46 can act together as the cathode of the capacitor 42, and the oxide layer 58 can act as a dielectric that separates the anode 56 from the cathode (e.g., the combined electrolyte 46 and cathode metal 54). The anode 56 can be electrically connected to a capacitor anode terminal 60, such as with an anode conductor 62. Similarly, the cathode metal 54 can be electrically connected to a capacitor cathode terminal 64, such as with a cathode conductor 66.

In an example, the capacitor 42 can be positioned within the chamber 40 so that the terminals 60 and 64 can be electrically connected to a firing mechanism. For example, the capacitor 42 can be positioned so that each terminal 60, 64 will be in electrical contact with a corresponding contact pad, such as an anode contact pad 68 in electrical contact with the capacitor anode terminal 60 and a cathode contact pad 70 in electrical contact with the capacitor cathode terminal 64. The anode and cathode contact pads 68 and 70 form part of an electrical circuit with the firing mechanism that can deliver an electrical pulse to the capacitor 42, such as via pulse delivery conductors 72, 74 (also referred to herein simply as "conductors 72, 74"). In an example, the firing mechanism includes an electrical pulse discharge subsystem that can deliver an electrical pulse to the capacitor 42 via the conductors 72, 74, as described in more detail below.

Continuing with FIG. 3B, once the firing mechanism is activated, an electrical pulse is delivered to the capacitor 42 through the conductors 72, 74. The electrical pulse is configured to supply a large specified amount of electrical energy to the capacitor 42 in a short specified period of time such that an overloading voltage potential will result between the anode 56 and the combined cathode metal 54 and the electrolyte 46. In an example, the large overloading voltage potential supplies enough energy to the capacitor 42 that it instantaneously or substantially instantaneously vaporizes the electrolyte 46, which generates a rapidly expanding cloud of vaporized electrolyte 76. The rapid expansion of vaporized electrolyte 76 generates a large propulsive force $F_P$, at least a portion of which is imparted onto the projectile 12 to drive it forward from the chamber 40 and into the barrel bore 44. In an example, the chamber 40 or the cartridge 50, or both, are configured to direct the expanding vaporized electrolyte 76 forward so that as much of the force generated by the expanding vaporized electrolyte 76 will be used as the propulsive force $F_P$ rather than expanding in other directions and/or generating wasted heat energy that dissipates through the weapon 10. For example, the chamber 40 can be sized and shaped so that the expanding vaporized electrolyte 76 is directed toward the bore 44. In another example, the cartridge 50 can include the casing 52, as mentioned above, which can be made from a material that is sufficiently strong to withstand the force of the expanding vaporized electrolyte 76 without breaching. The expanding vaporized electrolyte 76 can then be directed out of a distal opening 78 in the casing 52 so that the propulsive force $F_P$ of the expanding vaporized electrolyte 76 is directed forward to drive the projectile 12 down the bore 44 in the desired firing direction, as shown in FIG. 3C.

The potential energy available in the capacitor 42 to drive the projectile 12 is a function of the capacitance and voltage potential of the capacitor 42. In an ideal capacitor, the charge that the capacitor is able to store is defined by Equation [1]:

$$q_{Cap}=V_{Cap}\times C_{Cap} \quad [1]$$

where $q_{Cap}$ is the charge the capacitor is able to store, in coulombs (C), $V_{Cap}$ is the voltage across the capacitor, in volts (V), and $C_{Cap}$ is the capacitance of the capacitor, in farads (F). For the same capacitor, the energy that can be stored by the capacitor, and therefore the potential energy that can be discharged from the capacitor, is defined by Equation [2]:

$$E_{Cap}=\frac{1}{2}C_{Cap}\times V_{Cap}^2 \quad [2]$$

where $E_{Cap}$ is the energy storage capacity of the capacitor in question, in joules (J). In the case of the capacitor 42 in the example weapon 10 of FIGS. 1, 2, and 3A-3C, $E_{Cap}$ is equal to the potential energy that the capacitor can discharge that can be converted to kinetic energy to propel the projectile 12, which will also be referred to hereinafter as "projectile kinetic energy" or "$E_{K\ Proj}$."

For the purposes of illustration, in a non-limiting example, the capacitor 42 has a voltage potential of 100 V and a capacitance of 100,000 microfarads (μg). According to Equation [1], the example capacitor 42 is able to store a charge $q_{Cap}$ of 10 C, and according to Equation [2], the potential energy $E_{Cap}$ the capacitor 42 can store and discharge is 500 J. As will be appreciated by those having skill in the art in powder-based ammunition, a typical 0.22 inch caliber (5.6 mm) round is able to generate about 168 J of energy to propel the .22 caliber projectile. Therefore, this example capacitor 42 (i.e., 100 V, 100,000 μF) can potentially exert 297% of the energy onto the projectile 12 that the powder of a .22 caliber round can provide.

Of course, practically speaking, not all of this potential energy $E_{Cap}$ will actually be converted to projectile kinetic energy $E_{K\ Proj}$. For example, at least some of the stored electrical energy $E_{Cap}$ may not be discharged into the electrolyte 46, at least a portion of the discharged electrical energy may be converted to heat energy rather than kinetic energy, or at least a portion of the kinetic energy in the rapidly expanding vaporized electrolyte 76 can be misdirected to a structure other than the projectile 12, such as the cartridge casing 52 (if present) or the body of the weapon 10. Even if a sizeable percentage of the potential propulsive energy $E_{Cap}$ in the capacitor 42 is not converted to projectile kinetic energy $E_{K\ Proj}$ however, the weapon 10 will still be able to eject the projectile 12 with substantially more propulsive force $F_P$, and thus at a substantially higher velocity, than is possible with a typical .22 caliber powder-based round. For example, even if only 50% of the potential energy in the example capacitor 42 is converted to projectile kinetic energy $E_{K\ Proj}$, the weapon 10 will still generate 50% more projectile kinetic energy $E_{K\ Proj}$ than a typical .22 caliber powder-based round.

Electric Pulse Discharge Subsystem

As mentioned above, in an example the capacitor 42 is electrically overloaded in order to generate the propulsive force, such as by vaporizing an electrolyte 46 in the capacitor 42 as described above with respect with respect to the example shown in FIGS. 3A-3C. As is also mentioned above, in an example the capacitor 42 can be electrically overloaded by delivery of an overloading electric pulse to the capacitor 42, wherein the electric pulse has a specified current and/or a specified voltage for a specified period of time, which will also be referred to hereinafter as "the specified pulse period of time" or simply "the specified period."

Figure 4:
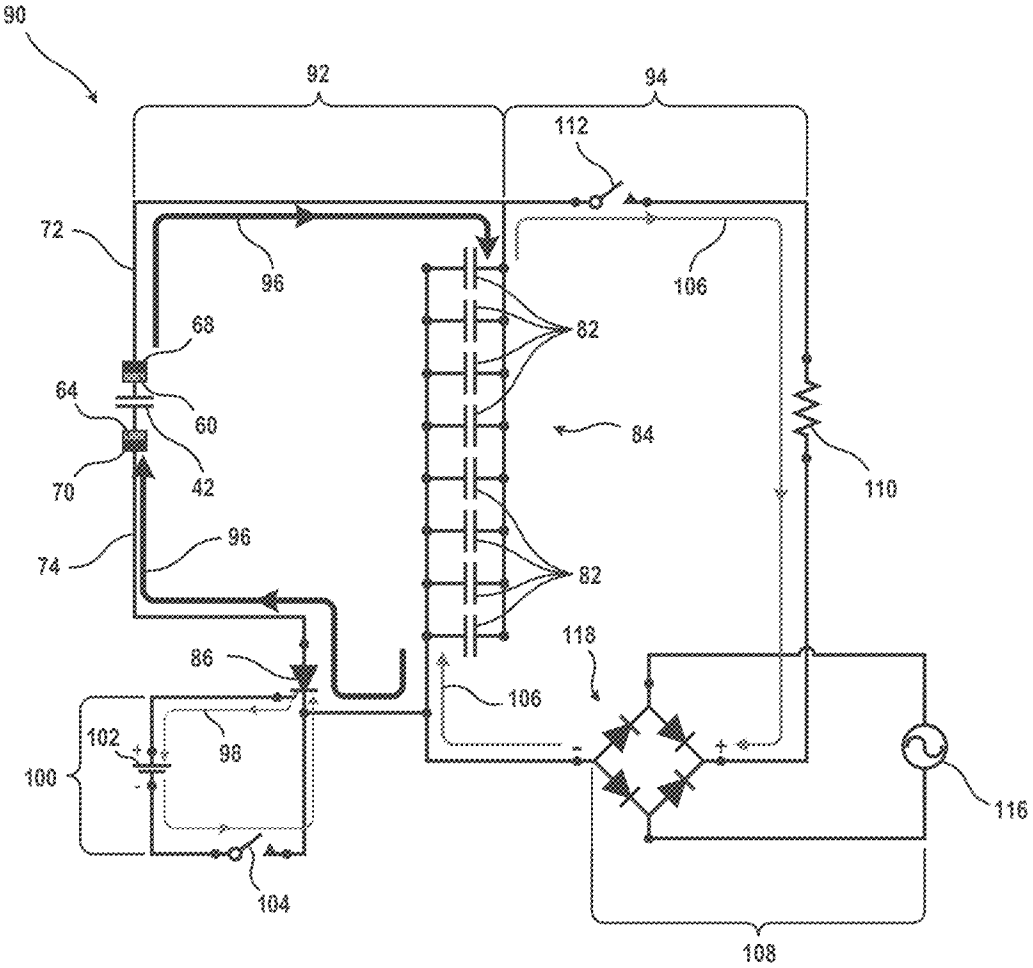
FIG. 4 is a circuit diagram of an example pulse discharge system to provide an electric pulse that can be used in the example weapon of FIGS. 1 and 2.

In an example, the overloading electric pulse that is delivered to the capacitor 42 is provided by an electric pulse discharge system. In a preferred example, the pulse discharge system is an on-board subsystem of the weapon 10, e.g., so that the weapon 10 can be fired without having to be tethered to a separate pulse discharge device. Returning to FIG. 2, in an example, the weapon 10 includes an electric pulse discharge subsystem 80 (also referred to hereinafter as "the pulse discharge subsystem 80") that is configured to generate and discharge an overloading electric pulse having the specified current and/or the specified voltage for the specified period. FIG. 4 shows a circuit diagram of an example pulse discharge circuit for the pulse discharge subsystem 80.

As described above, in an example the pulse discharge subsystem 80 supplies the electric pulse to the capacitor 42 via the conductors 72, 74. In an example, the conductors 72, 74 are electrically connected to the contact pads 68, 70 so that the electric pulse can be passed from the contact pads 68, 70 to the terminals 60, 64, and then to the anode 56 and the cathode metal 66, respectfully. The sudden surge in the voltage potential between the anode 56 and the cathode 46, 54 that results from the electric pulse then instantaneously or substantially instantaneously vaporizes the electrolyte 46, creating the propulsive force $F_P$ that drives the projectile 12, as described above with respect to FIGS. 3A-3C.

In an example, the pulse discharge subsystem 80 comprises a plurality of capacitors 82 connected in parallel. The parallel connection can allow each of the discharge capacitors 82 to be discharged simultaneously or substantially simultaneously The capacitors 82 of the pulse discharge subsystem 80 will be referred to as "the pulse discharge capacitors 82" or "the discharge capacitors 82" in order to distinguish them from the capacitor 42 that propels the projectile 12, which will be referred to hereinafter as "the propulsive capacitor 42." The plurality of discharge capacitors 82 of the pulse discharge subsystem 80 will be referred to collectively as a bank 84 of the discharge capacitors 82, or simply "the capacitor bank 84." The discharge capacitors 82 are configured, e.g., with a specified voltage and capacitance, and are connected together such that the all of the discharge capacitors 82 can be rapidly and simultaneously or substantially simultaneously discharged, generating the electric pulse in the specified pulse period and with the specified pulse amperage and/or the specified pulse voltage.

The parallel connection can allow each discharge capacitor 82 to rapidly discharge at the same time or substantially the same time as all the other discharge capacitors 82 in the capacitor bank 84. This simultaneous or substantially simultaneous discharging can allow the current discharging from all of the discharge capacitors 82 to combine as they come together into an electric pulse with a single conductive pathway, such as in one of the conductors 72, 74. The total combined energy discharging from all the discharging capacitors 82 results in the electric pulse having a sufficiently high current over a sufficiently short period of time such that the electric pulse will have sufficiently high energy to activate a propulsive charge (such as by overloading the propulsive capacitor 42), which drives the projectile 12 out of the weapon 10 at very high speeds.

The pulse discharge subsystem 80 can also include a switching device or mechanism that closes an electrical circuit between the capacitor bank 84 and the propulsive capacitor 42. In an example, the switching device or mechanism is operatively connected to the trigger 18 so that when the user of the weapon 10 pulls the trigger 18 it causes the electrical pulse to be discharged from the capacitor bank 84 through the conductors 72, 74 and into the propulsive capacitor 42.

In an example, the switching device or mechanism comprises an electrical pulse discharge switch 86 (also referred to hereinafter as "the switch 86") that switches between an open state or configuration and a closed state or configuration. When the switch 86 is in the open state or configuration, the electrical circuit that includes the capacitor bank, the conductors 72, 74, and the propulsive capacitor 42 is an open circuit, i.e., a broken circuit, such that electrical current cannot flow through the conductors 72, 74, and therefore such that the electric pulse cannot be discharged from the pulse discharge capacitors 82. When the switch 86 is in the closed state or configuration, the electrical circuit is closed and electrical current can flow through the conductors 72, 74 to the propulsive capacitor 42, which permits the electric pulse to be discharged from the bank of discharge capacitors 82 and to be passed to the propulsive capacitor 42 in order to overload the capacitor 42 to generate the propulsive force $F_P$ that propels the projectile 12 forward from the chamber 40.

The discharge switch 86 can include a mechanical-based switching device, or a circuit-based switching device, or both. A mechanical-based switching device is physically movable between a first position corresponding to the open state or configuration and a second position corresponding to the closed state or configuration, or a circuit-based switching device. Examples of mechanical-based switching devices that can be used as at least part of the switch 86 include, but are not limited to, a toggle switch or a mechanical limit switch.

A circuit-based switching device can include a semiconductor structure that can be electrically actuated between a first electrical state wherein no electrical current can pass through the circuit structure, which corresponds to the open state or configuration and a second electrical state wherein electrical current can pass through the circuit structure, which corresponds to the closed state or configuration. Examples of circuit-based switching devices that can be used as at least part of the switch 86 include, but are not limited to: a diode switch; a bipolar junction transistor switch; a junction field-effect transistor switch; an insulated gate field-effect transistor switch, such as a metal-oxide-semiconductor field-effect transistor (MOSFET) switch; or a thyristor-based switch, such as a Shockley diode, a silicon-controlled rectifier (SCR), or a silicon-controlled switch (SCS).

Electric Pulse Discharge and Charging Circuit

FIG. 4 shows a circuit diagram of an example electric pulse discharge and capacitor bank charging circuit 90, which will also be referred to hereinafter as "the pulse discharge and charging circuit 90" or simply as "the circuit 90." In an example, the circuit 90 is configured to discharge an electric pulse having the specified amperage and/or the specified voltage for the specified period of time to the propulsive capacitor 42. In an example, the circuit 90 includes a pulse discharge circuit loop 92 and a capacitor bank charging circuit loop 94 (also referred to as "the electric pulse loop 92" and "the charging loop 94," respectively).

As its name implies, the electric pulse loop 92 provides the electrical connection between the capacitor bank 84 and the propulsive capacitor 42 so that when the capacitor bank 84 is discharged the resulting overloading electric pulse will be supplied to the propulsive capacitor 42. The flow of the overloading electric pulse 96 is represented by the large arrow in FIG. 4 through the electric pulse loop 92. The direction of the arrow corresponds to the direction that electrons are actually flowing through the electric pulse loop 92. In other words, the arrow uses electron flow notation to indicate the actual direction of electron flow, as opposed to conventional current notation, which indicates the direction of positive charge flow. The same electron flow notation will be used to indicate the direction of electron flow for other parts of the circuit 90, as discussed below.

As discussed above, in an example the discharge capacitors 82 of the capacitor bank 84 are connected in parallel. The parallel arrangement results in the anode sides of each of the discharge capacitors 82 being in electrical communication with the cathode side of the propulsive capacitor 42. Similarly, the anode side of the propulsive capacitor 42 is in electrical communication with the cathode sides of the pulse discharge capacitors 82.

When the capacitor bank 84 is discharged, the electrons of the resulting electric pulse 96 are discharged from the anode sides of the pulse discharge capacitors 82 so that the electric pulse 96 is delivered to the cathode 46, 54 of the propulsive capacitor 42 via the pulse discharge conductor 74, the cathode contact pad 70, the cathode terminal 64, and the cathode conductor 66. As the propulsive capacitor 42 is overloaded, the electric pulse 96 passes between its cathode 54 and anode 56 (such as via an electric arc that forms internally with in the propulsive capacitor 42). The electrical energy of the electric pulse 96 can combine with at least a portion of the electrical charge that had been stored on the anode 56 and the cathode 46, 54 to vaporize the electrolyte 46 and generate the propulsive force $F_P$ from the rapidly expanding vaporized electrolyte 76, as described above. Then, the electrical energy that had crossed to the anode 56 exits the propulsive capacitor 42 so that the electric pulse 96 can return to the cathode sides of the discharge capacitors 82 in the capacitor bank 84.

As mentioned above, a pulse discharge switch 86 can be included to allow a user to initiate discharging of the capacitor bank 84 to generate the electric pulse 96, overload the propulsive capacitor 42 and drive the projectile 12 from the weapon 10. As shown in FIG. 4, the switch 86 can be included as part of the electric pulse loop 92 so that when the switch 86 is in the open state, the electric pulse loop 92 is a broken or open circuit so that the electric pulse 96 will not be able to be generated or transmitted to the propulsive capacitor 42. When the switch 86 is in its closed state, current can flow through the switch 86, which completes the electric pulse loop 92 so that there is an electrical pathway for the electrical energy stored in the capacitor bank 84 to flow as the electric pulse 96.

As noted above, the specific type of device or mechanism that is used as the switch 86 is not particularly important, and any practical mechanical-based or circuit-based switching device, or both, can be used to form the switch 86. In FIG. 4, the switch 86 is a circuit-based switch, and more specifically a silicon-controlled rectifier switch 86 (also referred to as "the SCR switch 86"). A silicon-controlled rectifier is a transistor-based device that can be turned "on" (also referred to as "latched") by application of a small switching voltage between a gate terminal and a cathode terminal, which results in a base current flowing out of the gate. This base current, which is also referred to as a control current 98 (represented by an arrow) causes the SCR switch 86 to be able to conduct a current of interest, such as the electric pulse 96, from the SCR cathode to the SCR anode, which allows the current of interest to flow through the SCR switch 86. The cathode and the anode of the SCR switch 86 are electrically coupled to the anode side of the capacitor bank 84 and to the cathode side of the propulsive capacitor 42, respectively. When the control current 98 is drawn from the gate of the SCR switch 86, the SCR switch 86 becomes latched and the electric pulse 96 is generated so that it can flow out of the anode side of the capacitor bank 84, through the SCR switch 86, to the cathode side of the propulsive capacitor 42.

In an example, the control current 98 is drawn from the gate of the SCR switch 86 via a triggering circuit loop 100 (also referred to hereinafter as "the trigger loop 100"). In an example, the trigger loop 100 includes a control current supply, such as a direct current (DC) battery 102. An advantage of using a silicon-controlled rectifier as the switch is that the amperage that is necessary for the control current to activate, or latch, the silicon-controlled rectifier, and the voltage necessary to generate the control current, are both very low compared to the current that can flow through and the voltage that can be applied across the silicon-controlled rectifier. Therefore, even though the voltage across the anode and cathode of the SCR switch 86 corresponding to the electric pulse 96 can be as high as 200 V or more, the battery 102 can be as low as a standard 9 V battery.

The trigger loop 100 can also include a firing switch 104 that activates the control current 98 through the trigger loop 100, e.g., so that the control current 98 does not flow until the firing switch 104 is engaged. As shown in FIG. 4, the firing switch 104 is a mechanical device that can move between an open position and a closed position. When the firing switch 104 is in the open position, as is shown in FIG. 4, the trigger loop 100 is an open circuit so that the control current 98 cannot flow. When the firing switch 104 is in the closed position, the trigger loop 100 becomes a complete, closed circuit so that the control current 98 can flow, and thus can activate the SCR switch 86.

In an example, the firing switch 104 is operatively coupled to a mechanical actuator of the weapon 10, such as the firing trigger 18 shown in FIGS. 1 and 2. When a user articulates the actuator, e.g., pulls the trigger 18, the firing switch 104 allows the control current 98 to flow from the battery 102, which then latches the SCR switch 86 so that the electric pulse 96 will be generated by the capacitor bank 84.

Another advantage of a silicon-controlled rectifier switch 86 is that the control current 98 need only be drawn from the gate of the SCR switch 86 for long enough for the electric pulse 96 to begin flowing through the SCR switch 86. Once the SCR switch 86 has been latched, the SCR switch 86 will remain latched and able to conduct the electric pulse 96 until the current of the electric pulse 96 falls below a cutoff current (which is lower than the amperage needed for the control current 98 to activate the SCR switch 86 in the first place). Since the electric pulse 96 begins flowing essentially instantaneously after the SCR switch 86 is activated by the control current 98, this means that the control current source, e.g., the battery 102, need only supply the control current 98 for a very short period of time. After that point, the trigger loop 100 can be re-opened and the control current 98 can be ceased without cutting off the electric pulse loop 92.

In an example, the firing switch 104 is configured so that when a user releases the force on the trigger 18, a biasing force acts on the firing switch 104 so that it will be moved into the open position. In other words, the firing switch 104 is configured to be in the open position by default unless a force is exerted on it (e.g., by the user pulling the trigger 18) to overcome the biasing force and move the switch 104 to the closed position.

The capacitor bank charging loop 94 provides an electrical current that is capable of charging the discharge capacitors 82 of the capacitor bank 84, which is also referred to as a "charging current" 106 (represented by an arrow in FIG. 4). In an example, the charging current 106 is designed to have electrical properties (e.g., current, voltage, and duration) that is able to charge the discharge capacitors 82 to their full capacity such that the capacitor bank 84 will be able to generate a new electric pulse 96 to overload a new propulsive capacitor 42.

Capacitors such as the discharge capacitors 82 require a DC current as the charging current 106. In an example, the charging loop 94 includes a source 108 for the charging current 106 (also referred to as "the charging source 108"). The charging source 108 can be any device or combination of devices that are capable of generating the charging current 106 as DC current and with specified electrical properties (e.g., a specified amperage at a specified voltage). A specific example of the charging source 108 is described in more detail below.

As mentioned above, when the electric pulse 96 is generated by the capacitor bank 84 so that the electric pulse 96 flows through the electric pulse loop 92, the electrons of the electric pulse 96 are discharged from the anode sides of the discharge capacitors 82. In an example, the charging source 108 is configured to supply the charging current 106 into the discharge capacitors 82 in the opposite direction. In other words, in an example, the charging source 108 is configured so that the electrons of the charging current 106 flow into the anode sides rather than out of the anode sides of the discharge capacitors 82, as occurs during discharging of the capacitor bank 84. As the charging current 106 flows into the anode sides of the discharge capacitors 82, electrons flow out of the cathode sides such that the charging current 106 can pass through the remainder of the charging loop 94.

In an example, the charging loop 94 also includes a resistor 110 connected in series with the capacitor bank 84, which can limit the amperage of the charging current 106 in order to protect the discharge capacitors 82 and the charging source 108 from an overly high current flow. In particular, the resistor 110 can protect the discharge capacitors 82 during the initial activation of the charging current 106 because at that time the terminal voltage of the discharge capacitors 82 is zero, which can theoretically result in unlimited current through the charging loop 94, which could overload and damage the discharge capacitors 82, the wiring of the charging loop 94, or the components of the charging source 108.

The charging loop 94 can also include a charging switch 112 that activates the charging current 106 flow through the charging loop 94. In an example, the charging switch 112 is a mechanical switch that can be moved between an open position and a closed position, similar to the firing switch 104. When the charging switch 112 is in the open position, the charging loop 94 is an open circuit so that the charging current 106 cannot flow. When the charging switch 112 is in the closed position, the charging loop 94 becomes a complete, closed circuit so that the charging current 106 can charge the discharge capacitors 82.

In an example, the charging switch 112 is operatively coupled to a second mechanical actuator of the weapon 10 so that a user can control charging of the discharge capacitors 82 of the capacitor bank 84. In an example, the mechanical actuator that initiates charging of the discharge capacitors 82 is a second trigger 114, also referred to as "the charging trigger 114," that is separate from the firing trigger 18 described above. When a user articulates the charging trigger 114, the charging switch 112 is moved from the open to the closed position, which causes the charging current 106 to charge the discharge capacitors 82 of the capacitor bank 84.

In an example, the charging source 108 includes an alternative current (AC) source 116. For example, the AC source 116 can be standard AC voltage provided by an electrical utility, such as 120 V or 240 AC current provided in the United States or the 220 V AC that is generally provided in Europe. As mentioned above, in general, capacitor charging requires a DC current. Therefore, in an example charging source 108 includes a device or devices that can convert the AC current provided by the AC current source 116 to the DC charging current 106, such as an AC to DC rectifier 118.

In a system where the initial charging source 108 is an AC source 116, as in the example circuit 90 shown in FIG. 4, practically speaking the AC current source 116 will be external to the weapon 10 so that the capacitor bank 84 would only be chargeable by plugging the weapon 10 into the external AC source 116. However, the weapon 10 is not limited to a configuration that requires plugging in to enable charging. In an alternative example, the weapon 10 can include an alternate charging source 108' that can be incorporated directly in the weapon 10 itself. As shown in FIG. 2, the alternate charging source 108' comprises a set of one or more second capacitors 120 that are configured so that when the one or more capacitors 120 are discharged it generates the charging current 106 that can charge the capacitor bank 84. For this reason, the set of one or more second capacitors 120 are also referred to hereinafter as "the charging capacitors 120."

The one or more charging capacitors 120 can be part of the charging loop 94, e.g., by being electrically connected to the capacitor bank 84 so that the charging current 106 generated by the discharging capacitor or capacitors 120 will act to charge the discharge capacitors 82. As shown in FIG. 2, the charging switch 112 can be operatively coupled to the charging trigger 114, such as with a conductor that activates an electrically activated switch 112 (as shown in FIG. 2) or via a mechanical linkage. In an example, the one or more charging capacitors 120 can be recharged by an external electrical source, such as an AC source that is the same as or different from the AC source 116 described above for the charging source 108.

The system of the present disclosure is not limited to using an AC source as the charging source. Any electrical system or subsystem that is capable of supplying electrical current for the purpose of charging capacitors (e.g., the discharge capacitors 82 or the charging capacitors 120) can be used. Another non-limiting example of such an electrical system or subsystem is the microwave energy rectifying and converting system described in U.S. Pat. No. 3,434,678, the entire disclosure of which is incorporated herein by reference in its entirety. The system described therein includes an antenna array configured to convert microwave energy to direct current (DC), which can then be used to charge the capacitors 82 of the capacitor bank 84 and/or the one or more charging capacitors 120.

Electrostatic Water Arc Explosion Propulsion

The propulsion provided by electrically overloading the propulsive capacitor 42 in order to propel the projectile 12 is not the only method of generating a propulsive force for which the weapon 10 can be configured. In another example, the electric pulse generated by the weapon 10 can be used to generate an electric arc that is passed through a small amount of water to result in the well-known, but not well-understood, phenomenon of water arc explosions. When the water is encountered by an electric arc having a sufficiently high current, the electric arc triggers a violent explosion of at least a portion of the water that is manifested as a very dense cloud of water or fog droplets that rapidly expands after the electric arc-initiated explosion. Remarkably, the electric arc does not cause substantial heating of the water or the resulting fog cloud, with the temperature of the fog in the cloud being no more than a few degrees higher than the original water temperature.

The water arc explosion phenomenon is described in more detail in Graneau et al., "Arc-liberated chemical energy exceeds electrical input energy," J. Plasma Physics, vol. 63, p. 115 (2000) (hereinafter "Graneau"), the entire disclosure of which is incorporated herein by reference. Graneau hypothesizes that "electrodynamic forces in the current-carrying [electric] arc plasma . . . can furnish the mechanical surface-tension energy required for tearing bulk water apart into tiny fog droplets." (Graneau at p. 115.) The authors of the paper hypothesized that "the most likely source of the explosion energy is that stored by hydrogen bonds between the water molecules. This bond energy is said to be equal to the latent heat of evaporation, and therefore could contribute up to 2200 J (Graneau at p. 116) and that "the fog expels itself from the water at supersonic velocities." (Graneau, Abstract.)

Figure 5A:
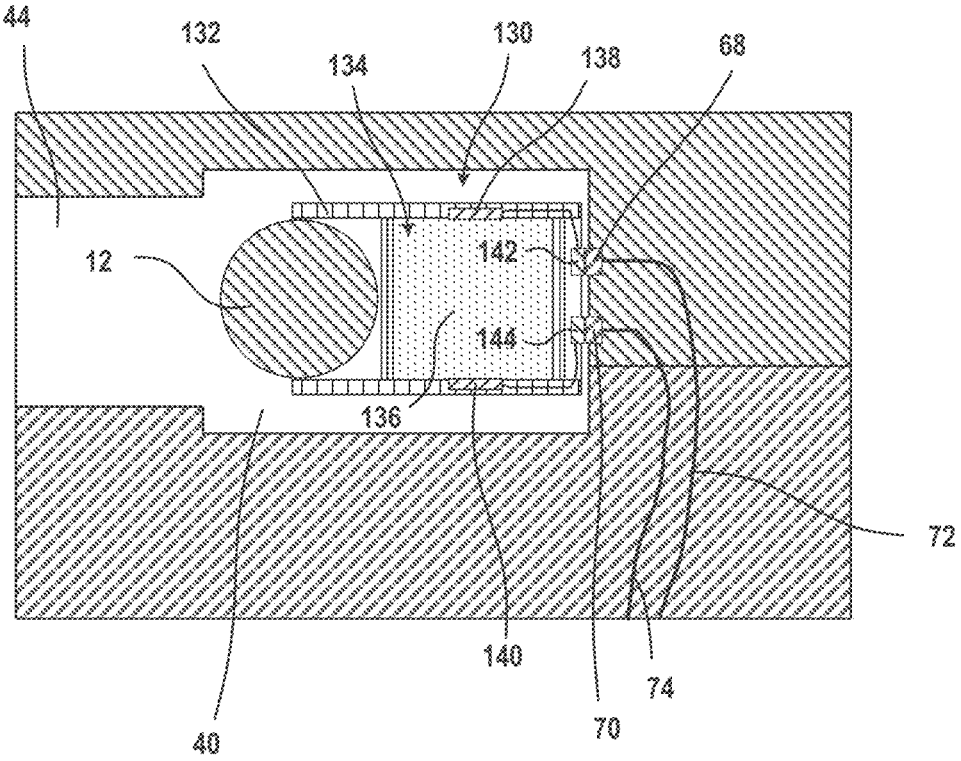
FIGS. 5A and 5B are close-up cross-sectional side views of an alternative example propulsive cartridge that uses the force generated by a water arc explosion to propel a projectile from the propulsion chamber in the example weapon of FIG. 1.
Figure 5B:
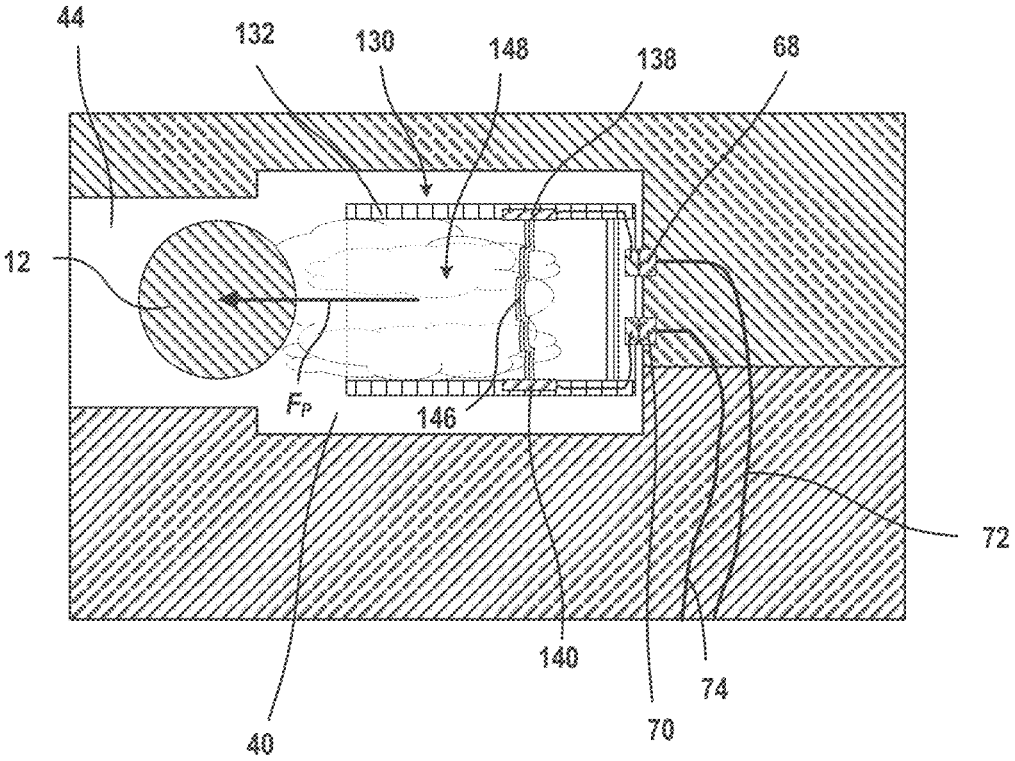

The water arc explosion phenomena can be exploited by the weapon 10 with little need for modification compared to the specific embodiments that use the capacitive-based propulsive energy described above with respect to FIGS. 1-4. FIGS. 5A and 5B show an example where the weapon 10 itself can be identical or substantially identical, with the main difference being the use of a water-containing cartridge 130 (also referred to hereinafter simply as "the water cartridge 130") rather than the capacitive cartridge 50 described above. In an example, the water cartridge 130 is positioned in the chamber 40 of the weapon 10.

In an example, the water cartridge 130 includes a casing 132 that encloses a water chamber 134 that holds a small amount of water 136. In an example, the casing 52 also at least partially surrounds a projectile 12 that is positioned in front of the water 136 in the water chamber 134.

In an example, the water cartridge 130 also includes an anode 138 and a cathode 140 that are adjacent to the water chamber 134, e.g., so that the water 136 can be in contact with one or both of the anode 138 and the cathode 140. The anode 138 and cathode 140 are spaced from one another, such as with the anode 138 being on a first side of the water chamber 134 and the cathode 140 being on an opposing second side of the water chamber 134, so that an electrical arc can form between the electrodes 138, 140 when an electric pulse is applied across them. In an example, the anode 138 is electrically connected to an anode terminal 142 and the cathode 140 is electrically connected to a cathode terminal 144. Similar to the propulsive capacitor 42 shown in FIG. 3A, the terminals 142, 144 can be positioned on the water cartridge 130 so that when the water cartridge 130 is positioned in a specified position in the chamber 40, the anode terminal 142 will be in electrical contact with the anode contact pad 68 and the cathode terminal 144 will be in electrical contact with the cathode contact pad 70.

In an example, the same or substantially the same structures on the weapon 10 that were described above with respect to FIGS. 3A-3C and 4 for delivering an electric pulse to the propulsive capacitor 42 can deliver an electric pulse to the water cartridge 130 in order to cause an electrical arc to pass through the water 136. Specifically, the pulse discharge subsystem 80 can supply the electric pulse to conductors 72, 74 that are in electrical contact with the contact pads 68, 70. The contact pads 68 and 70 are in electrical contact with the anode terminal 142 and the cathode terminal 144, respectively, so that when the electric pulse is delivered through the conductors 72, 74 and the contact pads 68, 70, it will create a sufficient voltage difference between the anode 138 and the cathode 140 to generate an electrical arc 146 therebetween, as shown conceptually in FIG. 5B.

Continuing with FIG. 5B, when the water 136 encounters the electrical arc 146, it results in a water arc explosion in the form of a rapidly expanding dense mass that comprises some combination of vaporized water or tiny water droplets in the form of a fog cloud 148. In experiments described in published academic papers, including Graneau, the initial expansion of a fog cloud generated via a water arc explosion resulted in the fog droplets moving at supersonic speeds as high as 350 m $s^{-1}$ or more. The kinetic energy of the rapidly expanding fog cloud 148 is sufficient to produce a propulsive force $F_P$ to drive the projectile 12 forward from the chamber 40 and into the bore 44 to fire the projectile 12 from the weapon 10 at a high rate of speed.

In the example shown in FIGS. 5A and 5B, the anode 138 and the cathode 140 are located on opposing lateral sides of the water chamber 134 (or on opposing annular sides if the water chamber 134 is cylindrical) such that the resulting electrical arc 146 extends laterally across the water chamber 134 (or annularly for a cylindrical water chamber 134), e.g., from the top to the bottom in the orientation shown in FIG. 5B. However, those having skill in the art will appreciate that a relative positioning of the electrodes 138, 140 other than the lateral arrangement shown in FIGS. 5A and 5B can be used without varying from the scope of the invention. For example, the anode 138 and cathode 140 can be positioned on opposing axial sides of the water chamber 134, e.g., on the left and right ends of the water chamber 134 in the orientation shown in FIGS. 5A and 5B. Similarly, those having skill in the art will appreciate that the electrodes 138, 140 need not be exactly on opposing sides of the water chamber 134, but rather can be placed in any relative position so long as the electrical arc 146 is able to form in such a way that the water arc explosion will be triggered and will generate the fog cloud 148 with sufficient propulsive force $F_P$.

Figure 6A:
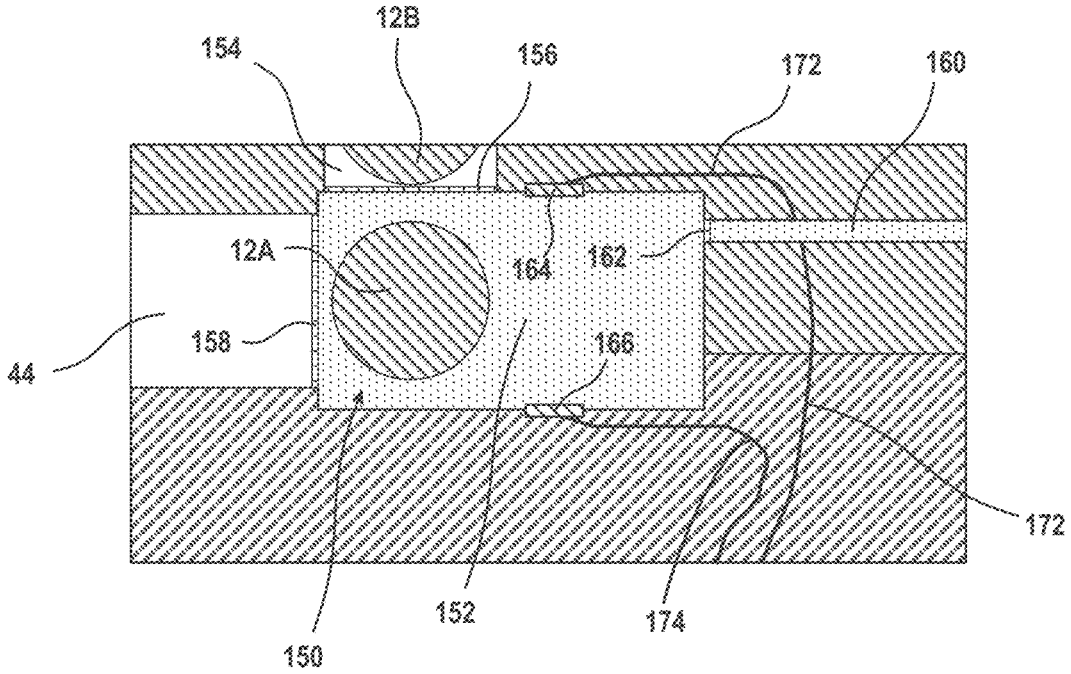
FIGS. 6A and 6B are close-up cross-sectional side views of a water arc chamber that uses the force generated by a water arc explosion of at least a portion of water in the water arc chamber to propel a projectile from the water arc chamber in an example weapon similar to the weapon of FIG. 1.
Figure 6B:
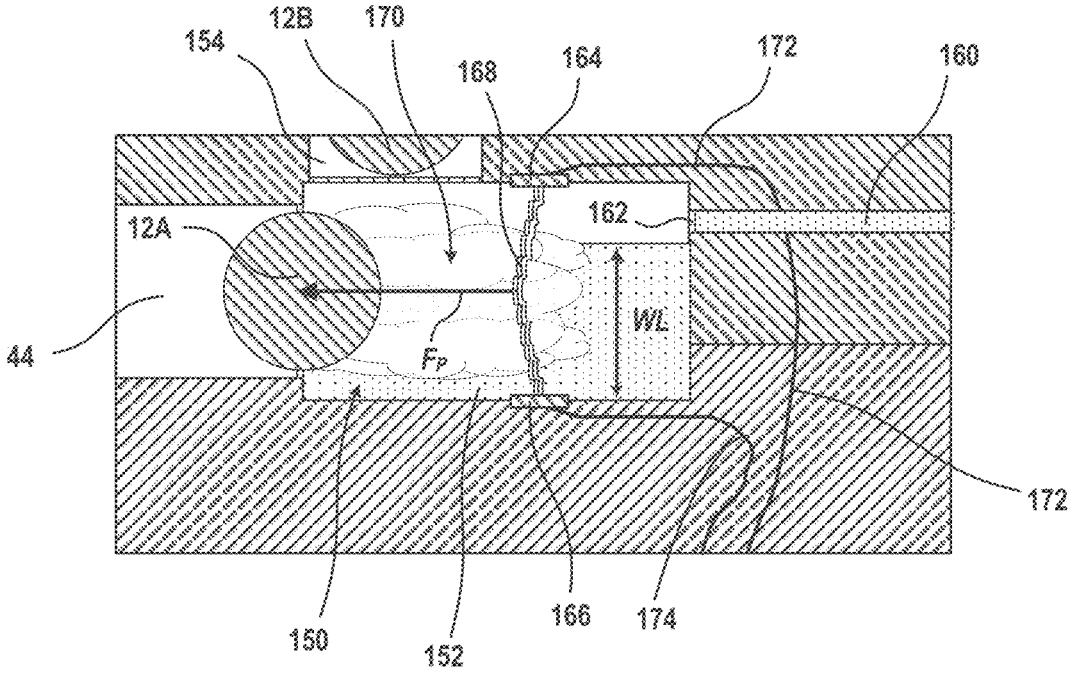

In another example, shown in FIGS. 6A and 6B, an alternative weapon can have a configuration that harnesses the propulsive force $F_P$ of a water arc explosion without using a self-contained water cartridge 130. The alternative weapon can have essentially all of the same structures as described above for the weapon 10, but with a modified chamber 150 that is configured to contain not only the projectile 12, but also a specified amount of water 152 through which an electrical arc can be passed to generate a propulsive water arc explosion. For this reason, the modified chamber 150 will also be referred to herein as "the water arc chamber 150."

Because the projectile 12 is not part of a larger cartridge that also includes water for the water arc explosion, as in the water cartridge 130, the configuration shown in FIGS. 6A and 6B allows free, unattached projectiles 12 to be dropped into the water arc chamber 150 for firing. In an example, a projectile feed chute 154 can be included that feeds into the water arc chamber 150 so that after a first projectile 12A is fired from the water arc chamber 150, a second projectile 12B can be fed into the water arc chamber 150. An optional divider 156 can be included to separate the projectile feed chute 154 from the water arc chamber 150. In an example, the divider 156 can be movable to allow for control of when the second projectile 12B is dropped into the water arc chamber 150. The divider 156 can also prevent or minimize leaking of water 152 into the projectile feed chute 154. A similar divider 158 can be positioned in the mouth between the water arc chamber 150 and the bore 44 to prevent or minimize the water 152 from flowing into the bore 44. In an example, the divider 158 can be movable so that the mouth between the water arc chamber 150 and the bore 44 can be briefly opened when the projectile 12A is to be fired out of the chamber 150 and into the bore 44 and then closed again after the projectile 12A has passed.

In an example, the water arc chamber 150 is a refillable vessel into which separately flowable water 152 can be fed if additional water 152 is needed after firing. Because the water 152 is free flowing, it will also be referred to herein as "free water 152." A water feed line 160 in fluid communication with the water arc chamber 150 can feed free water 152 to the chamber 150. A valve 162 can be included to control the flow of the free water 152 through the feed line 160. The valve 162 can be configured so that it will open and permit additional free water 152 to flow into the chamber 150 when the water level WL within the chamber 150 (shown in FIG. 6B) falls below a specified level. In an example, a water level monitor device can be included to determine the current water level WL or water volume within the chamber 150.

The propulsion mechanism for the projectile 12A from the water arc chamber 150 in FIGS. 6A and 6B is nearly identical to that of the projectile 12 of the water cartridge 130 in FIGS. 5A and 5B, even if the physical configurations of the chambers 40 and 150 are different. The example shown in FIGS. 6A and 6B also includes an anode 164 and a cathode 166 adjacent to the chamber 150, e.g., so that the free water 152 can be in contact with one or both of the electrodes 164, 166. The electrodes 164, 166 are spaced from one another, such as with the anode 164 being on a first side and the cathode 166 being on an opposing second side of the chamber 150 so that an electrical arc can form therebetween.

In an example, the anode 164 is electrically connected to a first conductor 172 and the cathode 166 is electrically connected to a second conductor 174 and the conductors 172, 174 can be connected to a pulse discharge system, which can be identical or substantially identical to the pulse discharge subsystem 80 of the weapon 10. In other words, the conductors 172, 174 can perform the same or substantially the same function and be connected in the same or substantially the same way as the conductors 72, 74 of the weapon 10, as described above with respect to FIGS. 2, 3A-3C, and 4.

In an example, similar structures to those described above for FIGS. 3A-3C and 4 for electric pulse delivery to the propulsive capacitor 42 can be included to deliver an electric pulse to the water arc chamber 150 and generate an electrical arc through the free water 152. Specifically, a system that is the same or substantially the same as the pulse discharge subsystem 80 can supply the electric pulse to conductors 172, 174, which are electrically connected to the anode 164 and cathode 166, respectively, so that when the electric pulse is delivered through the conductors 172, 174, it will generate an electrical arc 168 between the anode 164 and cathode 166, as shown conceptually in FIG. 6B.

Continuing with FIG. 6B, when the free water 152 encounters the electrical arc 168, a water arc explosion can be generated, which forms a rapidly expanding dense fog cloud 170 that comprises vaporized water or tiny water droplets, which can be similar or identical to the fog cloud 148 from the water cartridge 130 (described above). The kinetic energy of the rapidly expanding fog cloud 170 is sufficient to produce a propulsive force $F_P$ that drives the projectile 12A forward from the water arc chamber 150 at a high rate of speed.

In the example shown, the anode 164 and cathode 166 are located on opposing lateral sides and the electrical arc 168 extends laterally across the chamber 150, e.g., from the top to bottom in FIGS. 6A and 6B. However, a different relative positioning of the electrodes 164, 166 can be used. For example, the electrodes 164, 166 can be positioned on opposing axial sides of the chamber 150, e.g., on the left and right ends in FIGS. 6A and 6B. The electrodes 164, 166 need not be exactly on opposite sides of the chamber 150 so long as they are sufficiently spaced for the electrical arc 168 to form and the water arc explosion to be triggered.

Superconducting Pulse Conduction Pathways

The electric pulse produced by the weapon system can have a very high amperage and/or a very high voltage to ensure that the electric pulse is sufficient to electrically overload the propulsive capacitor 42 or to generate the water arc explosion. Similarly, the charging current 106 can also have a relatively high amperage or voltage, or both, in order to recharge the capacitor bank 84. Therefore, in an example, one or more of the conductive pathways within the circuit 90 can comprise a superconducting structure so that electrical losses will be minimized or essentially eliminated. In addition, one or more superconducting pathways can also improve thermal management because there will be little or no heat dissipation corresponding to current (e.g., the electric pulse 96 or the charging current 106) passing through the conductive pathways.

A superconductor can be particularly beneficial when used for pathways that carry the electric pulse 96 (e.g., the conductors 72, 74 in the electric pulse loop 92) because of the very high current and/or voltage associated with the electric pulse 96. But a superconductor can be beneficial when used for other conductive pathways as well. For example, a superconductor could be used for the wiring of the charging loop 94 or for the charging source 108.

One non-limiting example of a superconducting structure that can be used to form one or more of the conductive pathways is the superconductor described in U.S. Pat. App. No. US 2019/0348597 A1, the entire disclosure of which is incorporated herein by reference in its entirety. The superconductor described therein is a piezoelectricity-induced high temperature superconductor formed from a wire comprising an insulator core with a relatively thin coating, which can be made from a piezoelectric material, such as a lead zirconate titanate (PZT) ceramic or any other material that induces a sufficient piezoelectric effect. Other coating materials are also described, e.g., a thin "normal metal," such as aluminum. When a pulsed current is passed through the superconducting wire, high temperature (e.g., ≥25° C.) superconductivity is induced.

Propulsive Charge Loading Subsystem

The weapons described herein can also include a loading subsystem that is configured to load the structure or structures that provide the propulsive force, which will also be referred to herein as "the propulsive charge." In an example, the loading subsystem loads a propulsive charge material along with the projectile 12, into the relevant chamber where the propulsive force $F_P$ is generated. In the example weapon 10 of FIGS. 1, 2, and 3A-3C wherein the propulsive force $F_P$ is generated by electrically overloading the propulsive capacitor 42 (e.g., the propulsive capacitor 42 or its electrolyte 46 is the propulsive charge), the loading subsystem loads the propulsive capacitor 42 and the projectile 12 into the chamber 40. In examples where the projectile 12 and the capacitor 42 are combined into a single capacitive cartridge 50, the loading subsystem can be configured to load the cartridge 50 into the chamber 40.

In the example weapon that generates a water arc explosion with a water cartridge 130 (e.g., as in FIGS. 5A and 5B), the water 136 in the water cartridge 130 is the propulsive charge and the loading subsystem loads the water cartridge 130 into the chamber 40, so that both the projectile 12 and propulsive charge are loaded at the same time. Finally, in the example weapon that generates a water arc explosion with free water 152 in a chamber 150 (e.g., as in FIGS. 6A and 6B), the propulsive charge is the free water 152 and the loading subsystem can be configured to load one of the projectiles 12 and the water 152 into the chamber 150.

The loading subsystem can include one or more additional structures for storing additional projectiles 12 and/or additional propulsive charges (e.g., propulsive capacitors 42, capacitive cartridges 50, water cartridges 130, or free water 152) or for delivering the projectile 12 and an additional propulsive charge to the appropriate chamber 40, 150. An example of a storage structure includes, but is not limited to, the storage chamber 51 for the capacitive cartridges 50 described above. A similar storage chamber could be included for water cartridges 130. For the free water 152, the loading subsystem can include a water storage tank in fluid communication with the chamber 150, e.g., via the feed line 160. The loading subsystem can also include one or more passageways (not shown) through which the projectile 12 and/or the propulsive charges can be loaded into the respective chamber 40, 150, e.g., by connecting a storage structure to the chamber 40, 150.

The loading subsystem can include one or more mechanisms for loading one or both of the projectiles 12 and the propulsive charges into the respective chamber 40, 150. For example, such a mechanism can move an unfired propulsive capacitor 42 and a projectile 12 (either separately or as a unified capacitive cartridge 50) to the chamber 40, e.g., by moving the propulsive capacitor 42 and/or the projectile 12 from the storage chamber 51 to the chamber 40. The weapon can also include one or more mechanisms for ejecting from the weapon components that remain after the projectile is fired (such as spent casings 52 from the capacitors 42 or capacitive cartridges 50 or spent casings 132 from the water cartridges 130, e.g., as shown for the ejected spent casings 52 in FIG. 2).

Those having skill in the art of weapons design will be able to readily design mechanisms that can perform the projectile or propulsion charge loading function and/or the ejection function without any further guidance from the present disclosure.

Other Considerations

The example weapon 10 and the various example propulsive charge configurations (e.g., the propulsive capacitor 42 that is electrically overloaded in the chamber 40; or the water cartridge 130 or the water 152 in the water arc chamber 150 that is subjected to an electric arc to generate a water arc explosion) are described above as being configured for firing the projectile 12 from a rifle sized weapon 10 as depicted in FIGS. 1 and 2. Those having skill in the art will appreciate that the concepts and designs described in the present disclosure can be scaled up or down in size without varying from the scope of the present invention.

For example, a weapon in accordance with the present disclosure can be made at a larger size, such as a larger-sized portable weapon, such as a shoulder-mounted sized weapon, ground-based gun-type weapons (e.g., machine-gun sized), ground-based artillery (e.g., cannon-sized, tank barrel sized, or other large-sized shell ground artillery), or even as large as navel artillery. Scaling up the concepts of the present disclosure can include not only increasing the size of the weapon structures themselves, but also by upgrading the force and power that the propulsive charge can generate (e.g., by selecting a capacitor with a higher capacitance and/or a higher voltage rating for the propulsive capacitor 42 and/or generating an electric pulse with more electrical energy, i.e., with a higher amperage and/or over a shorter pulse period for the water arc explosion embodiments).

Similarly, a weapon in accordance with the present disclosure can be made at a smaller size, such as a weapon that can be held with one hand, such as a pistol sized weapon. The structures could be scaled down in size even smaller for the purposes of projecting structures that are substantially smaller than the weapon-sized projectile 12 described above. For example, those having skill in the art could design a system that is similar in configuration to the weapon 10, but that is designed to propel objects with a size in their smallest dimension (e.g., a diameter of a generally cylindrical or generally spherical object) of 1 millimeter (mm) or smaller rather than the ammunition-sized projectile 12 described above (e.g. from 172 caliber (about 0.127 inch, about 4 mm) to 50 caliber (about 0.5-0.51 inch, about 12.7-12.95 mm)). For example, a system could be designed using the propulsive charge concepts described above to propel a hypodermically-injectable object into a patient, such as for delivery of drug or therapeutic particles having a size on the micro scale (e.g., about 500 micrometer (μall) or less, such as 300 μm or less, for example 100 μm or less, such as 50 μm or less, for example 10 μm or less, such as 1 μm or less) or even particles on the nano scale (e.g., 750 nanometer (nm) or less, such as 500 nm or less, for example 400 nm or less, such as 300 nm or less, for example 250 nm or less, such as 200 nm or less, for example 100 nm or less, such as 50 nm or less, or 10 nm or less).

In other examples, those of skill in the art will be able to conceive of and design systems configures to use and activate the same types of propulsive charges described above (e.g., electrically overloading a capacitor or generating a water arc explosion) but not for the purpose of propelling a projectile. In other words, the systems and methods described herein can be designed as a projectile-less device or system where the propulsive force $F_P$ generated by the propulsive charge is used for another purpose. For example, the propulsive force $F_P$ can be used as a stunning force, e.g., so that the system or device is a flash bang type device or a stun gun type of system. In another example, the propulsive force $F_P$ can be used to propel the device or system itself or a larger structure to which the device or system is mounted, similar to the propulsion of a jet engine. In yet another example, the propulsive force $F_P$ can be used to create a mass of forced air or other fluid that is meant to encounter and act upon another material, such as by forming an air or water compression wave for the purpose of shaping the material onto another structure. In another example, the propulsive force $F_P$ can be used to drive an object within a predetermined path of travel for the purpose of doing work, for example for driving a piston or driver for a fastener driving tool (e.g., using the propulsive force $F_P$ generated by the propulsive charges described herein in place of air in a pneumatic tool or in place of the powder charge of a powder actuated tool.

Those having skill in the art will be able to appreciate or contemplate still other uses for the propulsive force $F_P$ generated by the propulsive charge types described herein. These other uses of the propulsive force $F_P$ without varying from the scope of the present disclosure.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A projectile propulsion system comprising:

a housing defining a propulsion chamber;

a propulsive charge loadable into the propulsion chamber, wherein the propulsive charge comprises a propulsive charge material, wherein the propulsive charge material comprises water loadable into the propulsion chamber;

a projectile loadable into a position in the propulsion chamber proximate to the propulsive charge material;

an electric pulse discharge subsystem configured to provide an electric pulse having a specified pulse amperage for a specified pulse period;

a current delivery subsystem electrically connecting the electric pulse discharge subsystem to the propulsive charge to deliver the electric pulse to the propulsive charge material, wherein the specified pulse amperage and the specified pulse period are sufficient to cause at least a portion of the propulsive charge material to generate a propulsive force that is at least partially directed onto the projectile to drive the projectile out of the propulsion chamber, wherein the electric pulse is supplied to the propulsion chamber and generates an electric arc through the water, wherein the specified pulse amperage and the specified pulse period are sufficient to generate a water arc explosion to form a dense fog cloud in the propulsion chamber, wherein expansion of the dense fog cloud generates the propulsive force; and a barrel in fluid communication with the propulsion chamber configured to receive the projectile as the projectile is driven from the propulsion chamber.

2. A projectile propulsion system according to claim 1, wherein the propulsive charge comprises a cartridge enclosing a chamber, wherein the chamber holds the water.

3. A projectile propulsion system according to claim 2, wherein the cartridge comprises an anode and a cathode that are adjacent to the chamber so that the water in the chamber is in contact with the anode and the cathode, wherein the electric arc forms between the anode and the cathode.

4. A projectile propulsion system according to claim 1, wherein the pulse discharge subsystem comprises a first capacitor bank configured to store a specified amount of electrical energy that is sufficient to generate the electrical pulse having the specified pulse amperage for the specified pulse period when the specified amount of electrical energy is discharged from the first capacitor bank.

5. A projectile propulsion system according to claim 4, wherein the first capacitor bank comprises a plurality of discharge capacitors connected in parallel.

6. A projectile propulsion system according to claim 4, wherein the pulse discharge subsystem includes a charging subsystem configured to charge the first capacitor bank.

7. A projectile propulsion system according to claim 1, wherein the current delivery subsystem comprises one or more superconductors.

8. A projectile propulsion system according to claim 1, further comprising a loading subsystem to load one or both of the projectile and the water into the propulsion chamber.

9. A projectile propulsion system according to claim 8, wherein the propulsion chamber is configured to receive free flowing water, wherein the loading subsystem comprises a water feed line to feed the free flowing water into the propulsion chamber.

10. A projectile propulsion system according to claim 1, further comprising a targeting system configured to assist a user in directing the projectile from the barrel.

11. A method of propelling a projectile, the method comprising:

generating an electric pulse from an electric pulse discharge system, the electric pulse having a specified pulse amperage for a specified pulse period;

delivering the electric pulse to a propulsive charge located in a propulsion chamber, the propulsive charge comprising water loadable into the propulsion chamber, wherein a projectile is positioned in the propulsion chamber proximate to the water;

directing the electric pulse through the water to generate an electric arc through the water, wherein the specified pulse amperage and the specified pulse period of the electric pulse passing through the water are sufficient to generate a water arc explosion to form a dense fog cloud in the propulsion chamber, wherein expansion of the dense fog cloud generates a propulsive force; and directing at least a portion of the propulsive force onto the projectile to drive the projectile out of the propulsion chamber.

12. A method according to claim 11, wherein the propulsive charge comprises a cartridge enclosing a chamber, wherein the chamber holds the water.

13. A method according to claim 12, wherein the cartridge comprises an anode and a cathode that are adjacent to the chamber so that the water in the chamber is in contact with the anode and the cathode, wherein the electric arc forms between the anode and the cathode.

14. A method according to claim 11, further comprising loading the water and the projectile into the propulsion chamber.

15. A method according to claim 14, wherein the propulsion chamber is configured to receive free flowing water, wherein the loading of the water into the propulsion chamber comprises flowing free water into the propulsion chamber.

16. A method according to claim 11, wherein the electric pulse discharge system comprises a first capacitor bank configured to store a specified amount of electrical energy that is sufficient to generate the electric pulse having the specified pulse amperage for the specified pulse period, the method further comprising discharging the specified amount of electrical energy from the first capacitor bank to form the electric pulse.

17. A method according to claim 16, wherein the first capacitor bank comprises a plurality of discharge capacitors connected in parallel.

18. A method according to claim 16, further comprising charging at least the specified amount of electrical energy to the first capacitor bank.

19. A method according to claim 11, wherein delivering the electric pulse to the propulsive charge comprises conducting the electric pulse through one or more conductive pathways that lead to the water.

20. A method according to claim 19, wherein at least one of the one or more conductive pathways comprises a superconductor, wherein the electric pulse is conducted through the superconductor.

* * * * *